US009405255B2

(12) United States Patent
Oguma

(10) Patent No.: US 9,405,255 B2
(45) Date of Patent: Aug. 2, 2016

(54) IMAGE FORMING APPARATUS AND IMAGE FORMING SYSTEM THAT PERFORM DIRECT PRINTING PROCESS USING A COOPERATION APPLICATION AND DIRECT PRINTING METHOD

(71) Applicant: KYOCERA Document Solutions Inc., Osaka (JP)

(72) Inventor: Takashi Oguma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/799,555

(22) Filed: Jul. 14, 2015

(65) Prior Publication Data

US 2016/0011557 A1 Jan. 14, 2016

(30) Foreign Application Priority Data

Jul. 14, 2014 (JP) ..... 2014-144057

(51) Int. Cl.
*G03G 15/00* (2006.01)

(52) U.S. Cl.
CPC ..... *G03G 15/5091* (2013.01)

(58) Field of Classification Search
CPC ..... G03G 15/5091; G03G 15/5075
USPC ..... 399/80, 79, 8
See application file for complete search history.

(56) References Cited

U.S. PATENT DOCUMENTS

2009/0251724 A1* 10/2009 Nakajima ..... G06F 21/608 358/1.15
2012/0154848 A1* 6/2012 Fukudome ..... G06F 3/1204 358/1.14

FOREIGN PATENT DOCUMENTS

JP 2005-014591 A 1/2005

* cited by examiner

*Primary Examiner* — Billy Lactaoen
(74) *Attorney, Agent, or Firm* — Hawaii Patent Services; Nathaniel K. Fedde; Kenton N. Fedde

(57) ABSTRACT

Provided is an image forming apparatus that can execute direct printing including authentication when a cooperation platform authenticates with substituting the device. It is connected to an external authentication server via a network. The image forming apparatus has an application and a direct print port. The application works on a specific platform. The direct print port is virtually-provided in the application. The application receives a job of the direct printing in the virtually-provided direct print port from an external terminal via the network. Then, the application instructs to authenticate to the authentication server based on certification information included in data of the job. The application, when authenticated, transmits print data to an actual direct print port.

9 Claims, 3 Drawing Sheets

IMAGE FORMING APPARATUS AND IMAGE FORMING SYSTEM THAT PERFORM DIRECT PRINTING PROCESS USING A COOPERATION APPLICATION AND DIRECT PRINTING METHOD

INCORPORATION BY REFERENCE

This application is based on and claims the benefit of priority from Japanese Patent Application No. 2014-144057 filed on Jul. 14, 2014, the contents of that are hereby incorporated by reference.

BACKGROUND

The present disclosure is related to an image forming apparatus, an image forming system, and an image formation method and is associated with the image forming apparatus, image forming system, and image formation method, for example, when performing an output process, executes processing in response to authentication of an authentication server on a network.

For image forming apparatuses, such as some printers and an MFP (Multi Functional Peripheral), printing is possible from a personal computer (henceforth "PC") via a network. In this case, a typical technology that permits an output after authenticating processing by a specific authentication server.

Also, image forming apparatus may be equipped a solution platform for cooperation processing (the following, it is called "cooperation platform") based on Internet standard technologies, such as JAVA (registered trademark) or a web browser. This cooperation platform realizes system extensibility of an image forming apparatus. Thereby, by an application that works on the cooperation platform cooperating with various apparatus is effectively-realizable as PC or a network is a center.

SUMMARY

An image forming apparatus related with a present disclosure is connected to an external authentication server via a network. The image forming apparatus has an application and a direct print port. The application works on a specific platform. The direct print port is virtually-provided in the application. The application receives the job of direct printing in the direct print port virtually-provided from an external terminal via the network. Then, the application instructs to authenticate to the authentication server based on certification information included in data of the job. The application, when authenticated, transmits print data to an actual direct print port.

An image forming system of the present disclosure is connected an external authentication server, an image forming apparatus, and an external terminal via the network. The image forming apparatus has application and a direct print port. An application works on a specific platform. A direct print port is virtually-provided in the application. The application receives a job of direct printing in the virtually-provided direct print port from the external terminal via the network. The application, in this time, instructs to authenticate to the authentication server based on certification information included in data of the job. The application, when authenticated, transmits print data to an actual direct print port.

An image formation method of the present disclosure is executed by an image forming apparatus connected to an external authentication server via a network. An application is worked on a specific platform. A direct print port is virtually-provided in the application. The application receives a job of direct printing in the virtually-provided direct print port from an external terminal via the network. The application, in this time, instructs to authenticate to the authentication server based on certification information included in data of the job. When authenticated, the application transmits print data to an actual direct print port.

DETAILED DESCRIPTION

Hereinafter, a form for carrying out the present disclosure (henceforth an "embodiment") is explained with reference to drawings.

Figure 1:
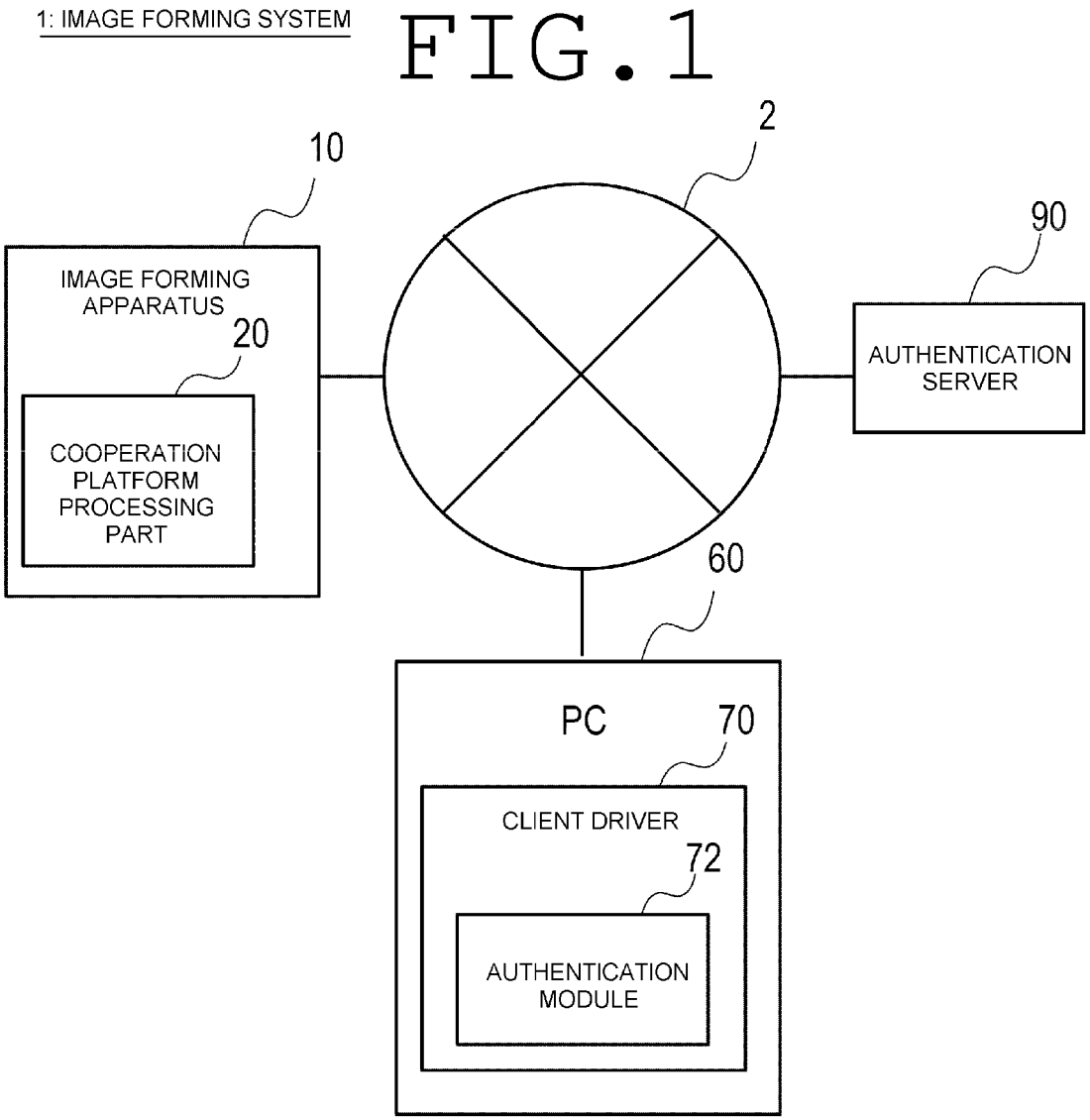
FIG. 1 is a system configuration diagram illustrating an outline configuration of an image forming system according to an embodiment.

FIG. 1 is a functional block diagram illustrating schematic structure of image forming system 1 according to the present embodiment. As shown in the illustration, image forming system 1 includes image forming apparatus 10, PC 60, and authentication server 90, which are mutually-connected via network 2.

Image forming apparatus 10 has cooperation platform processing part 20 that realizes system extensibility. Image forming apparatus 10 can cooperate with various apparatus as PC 60 or the other networks is a center.

PC 60 has client driver 70 for using image forming apparatus 10. Also, authentication server 90 performs authenticating process when there is access from PC 60 to image forming apparatus 10. Generally, image forming apparatus 10 receives print data from client driver 70 in PC 60. In this case, when a process is required to be authenticated, image forming apparatus 10 transmits user information included in the received print data to authentication server 90 with an authentication request. Authentication server 90 notifies an authentication notification to image forming apparatus 10 when the user information is registered as authentication possible. Image forming apparatus 10 that has received the authentication notification executes an output process of the print data from PC 60.

Figure 2:
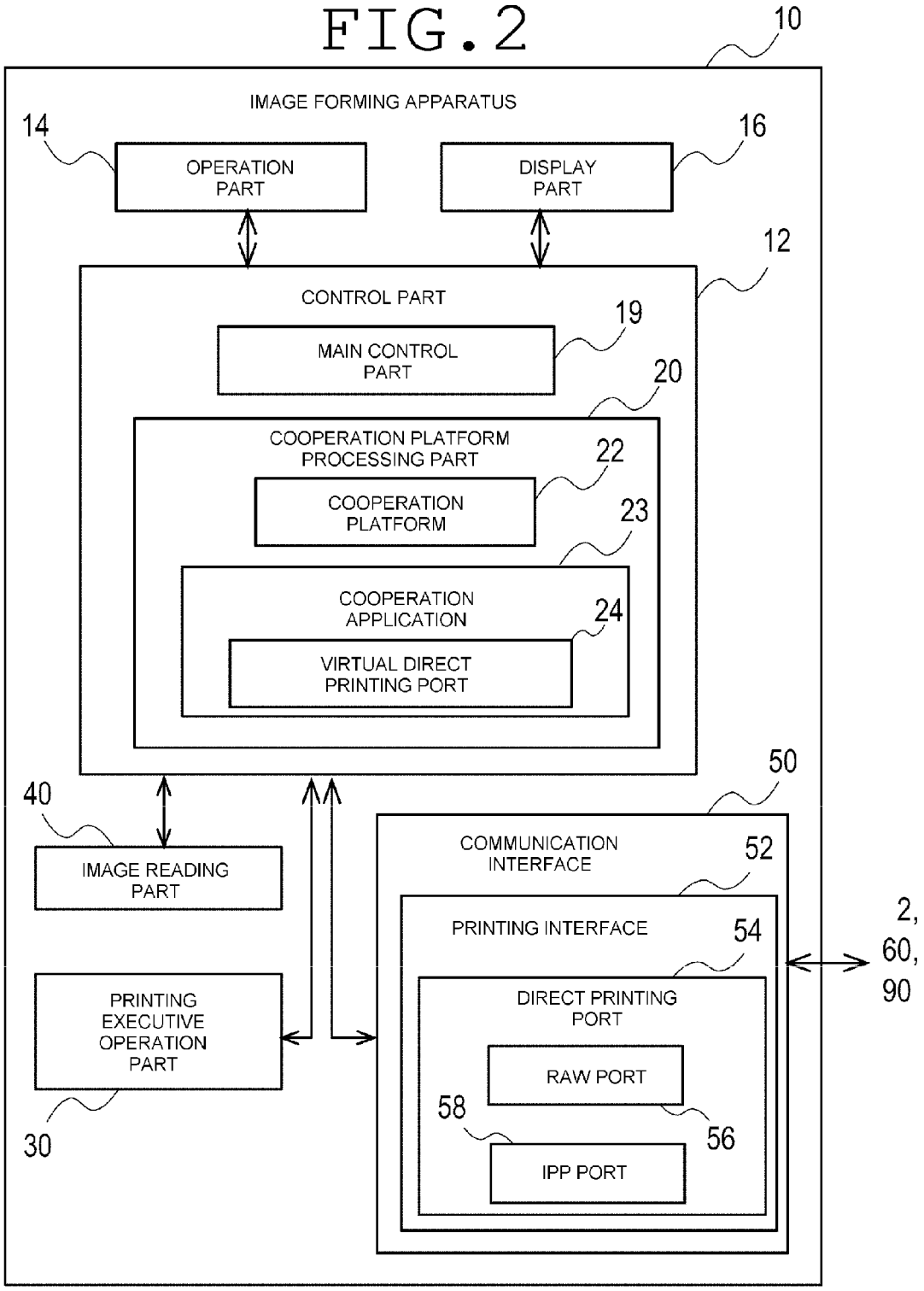
FIG. 2 is a functional block diagram of an image forming apparatus according to the embodiment.

FIG. 2 is a functional block diagram illustrating schematic structure of image forming apparatus 10. FIG. 2 is mainly indicated with paying attention to a direct printing process. For a configuration about other processes, illustration and explanation are omitted, suitably.

Image forming apparatus 10 is an MFP, for example. Image forming apparatus 10 includes control part 12, operation part 14, display part 16, printing executive operation part 30, image reading part 40, and communication interface 50.

Operation part 14 is a user interface having specific feature buttons, such as execution keys, numeric keypads, or the like. Display part 16 is configured with a liquid crystal panel, or the like, and displays an operating state, or the like. In addition, a touch key, which operation part 14 and display part 16 are combined and built, or the like, may be used.

Printing executive operation part 30 has general printing execution functions. Printing executive operation part 30 executes the print operation with an instruction from control part 12.

Image reading part 40 is a general configuration that can read a manuscript with A3 size or A4 size, for example. Image reading part 40 includes a scanner, platen glass, a manuscript reading slit, a manuscript sheet feeding device, or the like.

Control part 12 is an information processing part including a non-transitory recording medium. Control part 12 performs various kinds of processes. Here, control part 12 has main control part 19 as a function to perform generalized processing in image forming apparatus 10. Also, control part 12 has cooperation platform processing part 20 as a distinctive configuration in the present embodiment.

Cooperation platform processing part 20 includes cooperation platform 22 and cooperation application 23.

Cooperation platform 22 is a solution platform based on internet standard technologies, such as a web browser and a web service.

Cooperation application 23 is application that works on cooperation platform 22. Cooperation application 23 enables network cooperation with PC 60 or other apparatuses by using function of image forming apparatus 10.

Cooperation platform processing part 20, when a printing process from PC 60 is received, performs extended authentication as described later by using cooperation application 23. In detail, virtual direct printing port 24 is used. Thereby, direct printing, what is called, is realized. In order to realize direct printing, cooperation application 23 has a virtual direct printing port (henceforth "virtual direct printing port 24"). When the print data that specified the virtual direct printing port 24 are received, print data are transmitted to actual direct printing port 54 after authentication by authentication server 90.

Communication interface 50 is an interface for communicating with an external apparatus. Communication interface 50 includes a LAN interface, a USB interface for local connection, or the like. Here, it explains with assuming the LAN interface.

Communication interface 50 has printing interface 52 that receives data about printing from PC 60, or the like. The data about printing is print data, printing instructions, or the like. Printing interface 52 has direct printing port 54. Direct printing port 54 has RAW port 56 and IPP (Internet Printing Protocol) port 58.

Generally, when direct printing is performed, direct submission of the print data is performed from client driver 70 in PC 60 to direct printing port 54 in image forming apparatus 10. In this case, the RIP (Routing Information Protocol) component, which image forming apparatus 10 has, analyzes certification information included in printable data (the print data.) Then, the process, which a RIP component authenticates as needed, is executed.

However, it differs in the printing process by using cooperation application 23 in cooperation platform processing part 20. In this case, cooperation application 23 bears duty of the authentication about access from PC 60 to image forming apparatus 10. Therefore, the above-mentioned process, that is, the process that the RIP component analyzes certification information and authenticates, does not work.

Consequently, when executing direct printing in an environment where cooperation application 23 that performs extended authentication is worked, processing with authentication server 90 is performed as follows. Thereby, with authentication, direct printing becomes realizable.

Figure 3:
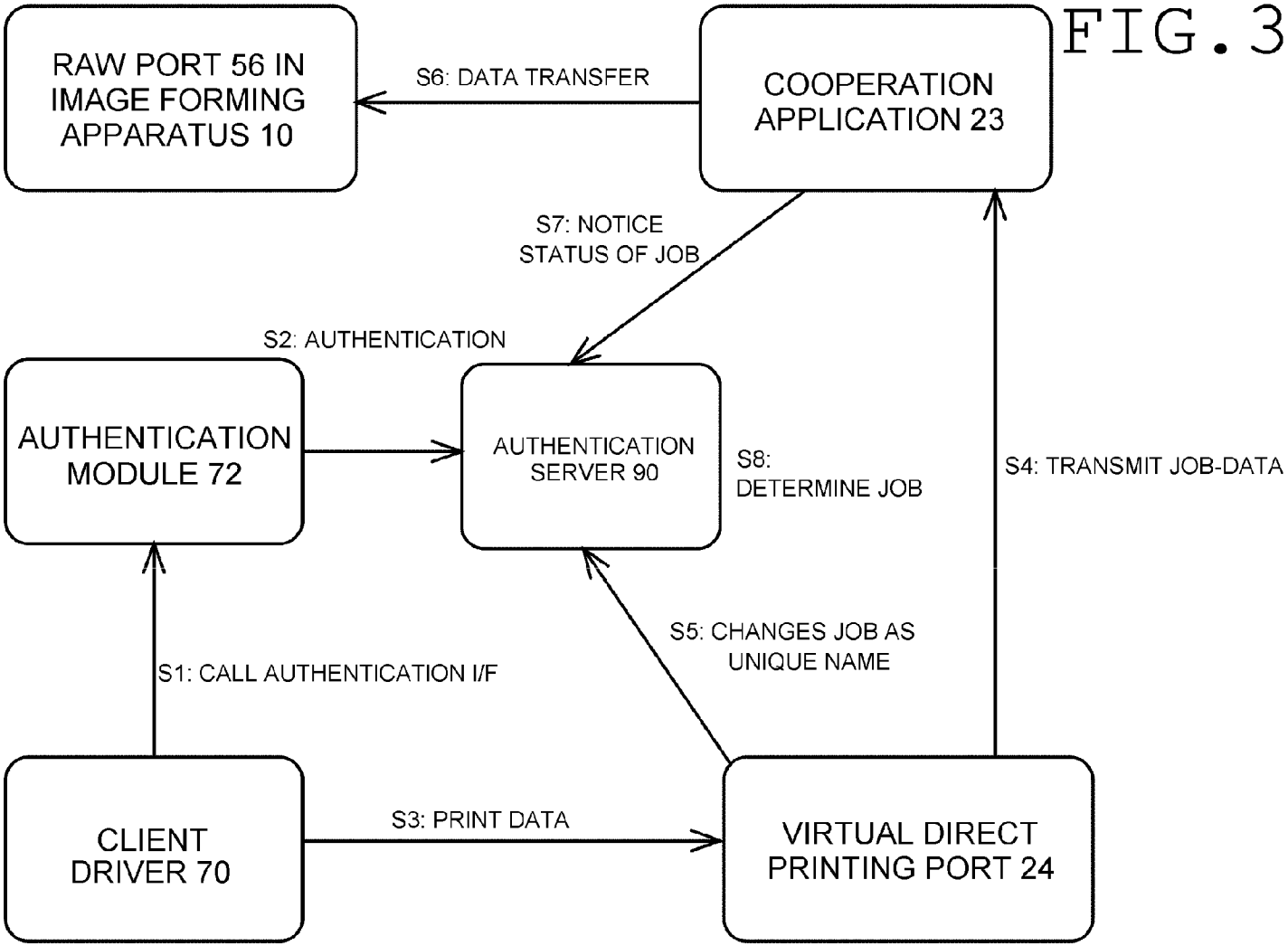
FIG. 3 is a chart figure illustrating a process at the time of performing direct printing by a cooperation platform according to the embodiment.

FIG. 3 shows a chart figure illustrating process of a case where client driver 70 in PC 60 performs the direct printing process accompanied by authentication in the environment where cooperation application 23 is worked.

In the environment where cooperation application 23 is operated, client driver 70 in PC 60 starts the execution of the printing process. Then, client driver 70 calls authentication module 72 (authentication interface,) which is used in a case of requiring authenticating process to authentication server 90 (S1).

Authentication module 72 requires authentication by using a web service to authentication server 90 (S2).

When authentication is successful, client driver 70 transmits the print data for performing a print by using direct printing port 54 to cooperation platform 22 in image forming apparatus 10 (S3).

Cooperation platform 22, in detail, which is virtual direct printing port 24 in cooperation application 23, transmits the received data. That is, cooperation application 23 transmits the received data to cooperation application 23 by using the web service, which acts as a host (S4).

In the case, the job name in the print data is changed into a unique name. This is because of enabling pursuit of the job. The unique name is made by virtual direct printing port 24 generating a unique GUID (Globally Unique Identifier.) Also, the information of a login user name is acquired by the print data. This is for identifying who executes the job.

Next, virtual direct printing port 24 transmits set information ("data 1,") which is the unique job name and the login user name, to authentication server 90 (S5).

Cooperation application 23 transmits the received print data to direct printing port 54 (RAW port 56, or the like,) internally (S6).

At this time, certification information, such as the user name, is excluded in the print data. If the certification information is previously deleted by cooperation application 23, the received print data is transmitted to direct printing port 54 as it is. If the certification information is included in the print data received from cooperation application 23, cooperation application 23 performs process to exclude the certification information. This is, if the certification information is included in the print data, a same process as the authenticating process in a normal direct printing process is accomplished, uselessly. Supposing, if disqualified certification information in authentication of the normal direct printing process remains, authentication is not be performed. In order to avoid the situation, the certification information is deleted. Here, this is because ensuring security by internal process can be estimated.

In addition, as replacing with the process that excludes certification information, a process for rewriting or a process for adding another certification information may be accomplished. Another certification information is suitable certification information for the authenticating process used for direct printing port 54. This can raise security.

Then, image forming apparatus 10 executes an event. That is, image forming apparatus 10 outputs the acquired print data from printing executive operation part 30.

Cooperation application 23 receives event information (a start, an end, or the like) in the job (print job) performed in image forming apparatus 10. Cooperation application 23 notifies event information with the job name to authentication server 90 (S7).

Authentication server 90 compares above-mentioned data and the transmitted event. Authentication server 90 determines and records whose job it is (S8).

As mentioned above, according to the present embodiment, extended authentication by using cooperation platform processing part 20 (cooperation platform 22, cooperation application 23) is performed. In this environment, even if in a case where image forming apparatus 10 has a request of a direct printing process from PC 60, the direct printing process that performs suitable authentication is realizable.

As explained in detail, in a typical case, a printout is performed from a driver for printing installed in PC to the image forming apparatus on a network. In this case, the direct printing that transmits print data to a RAW port, or the like, by using an interface by a standard TCP/IP port may be used. At this time, when the cooperation platform of the image forming apparatus performs extended authentication, an application on a cooperation platform authenticates by substituting authentication function to be primarily-implemented in the image forming apparatus. In this case, the problem is happened that direct printing by using an authentication server cannot be executed.

However, in the typical case, there is no technology supposing the cooperation platform, and another technology is required.

As compared with this, according to the present disclosure, even if in a case where it indicates to execute the job of direct printing to the application that works on a specific platform, in an image forming apparatus, direct printing including authentication can be executed, appropriately.

As the above, the present disclosure is explained based on the embodiment. This embodiment is an exemplification, and various modifications about the combination of each of those components are possible for it. Also, it is understood by the person skilled in the art that such a modification is also in the range of the present disclosure.

What is claimed is:

1. An image forming apparatus connected to an external authentication server and an external terminal via a network, the image forming apparatus comprising:

a direct printing port that includes a RAW port and an Internet Printing Protocol (IPP) port;

a printing executive operation part that executes a print operation;

a solution platform;

cooperation application that works on the solution platform, and enables network cooperation with the external authentication server or the external terminal by using functions of the image forming apparatus; and a virtual direct printing port that is virtually-provided in the cooperation application, wherein wherein the image forming apparatus performs a direct printing process, and wherein the direct printing process includes:

calling an authentication module in the external terminal, via a client driver in the external terminal;

requiring an authentication to the external authentication server, via the authentication module;

transmitting, if the authentication is successful, print data into the virtual direct printing port included in the cooperation application, via the client driver, wherein the print data transmitted via the client driver comprises certification information;

following the transmission of the print data into the virtual direct printing port, deleting the certification information from the print data, via the cooperation application;

following the deletion of the certification information from the print data, transmitting the print data into the direct printing port, via the cooperation application; and following the transmission of the print data into the direct printing port, executing the print operation based on the print data, via the printing executive operation part.

2. An image forming system connecting an external authentication server, an image forming apparatus, and an external terminal via a network, the image forming apparatus including:

a direct printing port that includes a RAW port and an Internet Printing Protocol (IPP) port;

a printing executive operation part that executes a print operation;

a solution platform;

a cooperation application that works on the solution platform, and enables network cooperation with the external authentication server or the external terminal by using functions of the image forming apparatus; and a virtual direct printing port that is virtually-provided in the cooperation application; and the external terminal including a client driver that transmits print data to the image forming apparatus; and an authentication module that requires an authentication to the external authentication server via the client driver, wherein the image forming system performs a direct printing process; and wherein the direct printing process includes:

calling the authentication module in the external terminal via the client driver in the external terminal;

requiring the authentication to the external authentication server, via the authentication module;

transmitting, if the authentication is successful, the print data into the virtual direct printing port included in the cooperation application, via the client driver, wherein the print data transmitted via the client driver comprises certification information;

following the transmission of the print data into the virtual direct printing port, deleting the certification information from the print data, via the cooperation application;

following the deletion of the certification information from the print data, transmitting the print data into the direct printing port, via the cooperation application; and following the transmission of the print data into the direct printing port, executing the print operation based on the print data, via the printing executive operation part.

3. A direct printing method performed by an image forming apparatus connected to an external authentication server and an external terminal via a network, wherein the image forming apparatus includes:

a direct printing port that includes a RAW port and an Internet Printing Protocol (IPP) port;

a printing executive operation part that executes a print operation;

a solution platform;

a cooperation application that works on the solution platform, and enables network cooperation with the external authentication server or the external terminal by using functions of the image forming apparatus; and a virtual direct printing port that is virtually-provided in the cooperation application, and the external terminal includes:

a client driver that transmits print data to the image forming apparatus; and an authentication module that requires an authentication to the external authentication server via the client driver, and the direct printing method comprising:

calling the authentication module in the external terminal, via the client driver in the external terminal;

requiring the authentication to the external authentication server, via the authentication module;

transmitting, if the authentication is successful, the print data into the virtual direct printing port included in the cooperation application, via the client driver, wherein the print data transmitted via the client driver comprises certification information;

following the transmission of the print data into the virtual direct printing port, deleting the certification information from the print data, via the cooperation application, following the deletion of the certification information from the print data, transmitting the print data into the direct printing port, via the cooperation application; and following the transmission of the print data into the direct printing port, executing the print operation based on the print data, via the printing executive operation part.

4. The direct printing method according to claim 3, further comprising:

changing a job name in the print data into a unique job name, via the cooperation application;

acquiring a login user name in the print data, via the cooperation application;

transmitting a set of the unique job name and the login user name into the authentication server, via the virtual direct printing port; and receiving event information of the print data from the printing executive operation part, via the cooperation application; and transmitting the event information with the unique job name into the external authentication server, via the cooperation application.

5. The direct printing method according to claim 4, wherein the unique job name includes a Globally Unique Identifier (GUID) that is made by the virtual direct printing port.

6. The image forming apparatus according to claim 1, wherein the direct printing process further includes:

changing a job name in the print data into a unique job name, via the cooperation application;

acquiring a login user name in the print data, via the cooperation application;

transmitting a set of the unique job name and the login user name into the external authentication server, via the virtual direct printing port; and receiving event information of the print data from the printing executive operation part, via the cooperation application; and transmitting the event information with the unique job name into the external authentication server, via the cooperation application.

7. The image forming apparatus according to claim 6, wherein the unique job name includes a Globally Unique Identifier (GUID) that is made by the virtual direct printing port.

8. The image forming system according to claim 2, wherein the direct printing process further includes:

changing a job name in the print data into a unique job name, via the cooperation application;

acquiring a login user name in the print data, via the cooperation application;

transmitting a set of the unique job name and the login user name into the authentication server, via the virtual direct printing port; and receiving event information of the print data from the printing executive operation part, via the cooperation application; and transmitting the event information with the unique job name into the external authentication server, via the cooperation application.

9. The image forming system according to claim 8, wherein the unique job name includes a Globally Unique Identifier (GUID) that is made by the virtual direct printing port.

* * * * *